US007850496B1

(12) United States Patent
Eichinger

(10) Patent No.: US 7,850,496 B1
(45) Date of Patent: Dec. 14, 2010

(54) LUBRICATION SYSTEM OF A MARINE PROPULSION DEVICE

(75) Inventor: Charles H. Eichinger, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 588 days.

(21) Appl. No.: 11/972,979

(22) Filed: Jan. 11, 2008

(51) Int. Cl.
*B63H 20/00* (2006.01)

(52) U.S. Cl. ..... 440/88 L; 123/196 R; 184/6

(58) Field of Classification Search ..... 123/195 C, 123/195 P, 196 R; 184/6, 6.21, 6.4; 440/88 L, 440/88 R See application file for complete search history.

(56) References Cited

U.S. PATENT DOCUMENTS 3,335,817 A * 8/1967 Horning ..... 184/6.21
4,397,198 A 8/1983 Borgersen et al.
4,872,531 A * 10/1989 Meisenburg et al. ..... 184/6.4
4,875,884 A 10/1989 Meisenburg
4,913,109 A 4/1990 Slattery
4,986,777 A 1/1991 Preston
5,236,380 A * 8/1993 Schueller et al. ..... 440/88 L
5,284,223 A 2/1994 Fisher
5,487,687 A 1/1996 Idzikowski et al.
5,899,779 A 5/1999 Hattori
6,132,275 A 10/2000 Tanaka et al.
6,478,646 B1 * 11/2002 Fukuoka et al. ..... 440/88 L
6,575,797 B1 6/2003 Martin et al.
6,655,341 B2 12/2003 Westerbeke, Jr.
6,755,704 B1 6/2004 Leinonen
6,837,210 B2 1/2005 Tsuchiya et al.
7,033,234 B2 4/2006 Arvidsson et al.
7,118,434 B2 10/2006 Arvidsson et al.
7,131,385 B1 11/2006 Ehlers et al.
7,182,657 B2 2/2007 Mansson
7,186,157 B2 3/2007 Mansson et al.
7,188,581 B1 3/2007 Davis et al.
7,234,983 B2 6/2007 Davis
7,267,068 B2 9/2007 Bradley et al.

* cited by examiner

*Primary Examiner*—Lars A Olson
(74) *Attorney, Agent, or Firm*—William D. Lanyi

(57) ABSTRACT

A lubrication draining and filling system provides oil passages that direct a flow of liquid oil from a bottom region of an oil sump, located within a rotatable portion of the marine propulsion system, to a discharge port which is connectable in fluid communication with a device that can sufficiently lower the pressure at the discharge port to induce the upward flow of oil from the lower portion of the oil sump within the gear case. The cavity of the oil sump within the gear case is disposed within a rotatable portion of the marine propulsion device while the discharge port is located within a stationary portion of the marine propulsion device. A transitional region comprises a space located between the stationary and rotatable portions. The oil can therefore flow from a rotatable portion, into the space, and then from the space into the stationary portion which allows it to be removed from the marine propulsion device.

20 Claims, 3 Drawing Sheets

LUBRICATION SYSTEM OF A MARINE PROPULSION DEVICE

BACKGROUND OF THE INVENTION

1. Field of the Invention

The present invention is generally related to a lubrication system of a marine propulsion device and, more particularly, to a lubrication system that facilitates the removal and replacement of lubricating oil from a marine drive unit that is suspended below the generally horizontal hull surface of a marine vessel.

2. Description of the Related Art

Those skilled in the art of marine propulsion systems are aware of many different types of lubrication systems that store and provide lubricating oil to various portions of the engine and drive unit of the marine propulsion device. As will be described in greater detail below, some marine propulsion devices present unique and difficult problems because of the location and configuration of the marine drive unit in relation to the marine vessel with which it is associated.

U.S. Pat. No. 4,397,198, which issued to Borgersen et al. on Aug. 9, 1983, describes a marine transmission assembly system. A reversing double cone clutch drive assembly for a boat comprising a horizontal input shaft, a vertical intermediate output shaft, a first housing provided with an opening in a side wall opposite to the input shaft and an opening in a bottom wall through which the lower end of said intermediate output shaft is exposed, and selectable gear transmission subassemblies attachable to such clutch drive assembly, each subassembly including a second housing with a generally horizontal wall for engaging such bottom wall, said second housing carrying a bearing which mounts an output shaft driven through gear means by the intermediate output shaft said housing being filled interiorly with lubricating oil, in heat exchange relationship with cooling water exterior of the housing are described.

U.S. Pat. No. 4,875,884, which issued to Meisenburg on Oct. 24, 1989, discloses a marine propulsion device with a through transom engine oil drain system. A fluid flow tube is provided which extends from the lower portion of an engine oil pan to a point on the boat transom below the pan. The upper end portion of the tube is connected through a control valve which communicates with the pan interior. The lower or discharge tube end portion is connected through a fitting extending through the transom. A removable plug is associated with the fitting and, when removed, permits oil to drain out through the transom and into an oil collection receptacle when the control valve is open.

U.S. Pat. No. 4,913,109, which issued to Slattery on Apr. 3, 1990, discloses a marine outboard drive with oil tank fill tube. It includes a two-cycle internal combustion engine, an oil storage tank storing lubricating oil for the engine, and a fill tube within the engine cowl for filling the oil tank therebelow. The fill tube includes a partitioned upper cup portion vented to the tank and closed by a tactiley hinged cap.

U.S. Pat. No. 4,986,777, which issued to Preston on Jan. 22, 1991, describes a marine engine oil drainage device. A discharge device includes a tubular casing which is snugly disposed within the drainage port in the stern of the vessel. The casing is hollow and has an exterior and an interior. The walls of the casing have drainage openings for allowing water in the bottom of the vessel to drain into the casing and out of the vessel via the drainage port.

U.S. Pat. No. 5,284,223, which issued to Fisher on Feb. 8, 1994, describes an apparatus and method for venting and for monitoring oil levels in marine outdrives. It includes an oil monitoring reservoir suitable for locating inside the boat. The reservoir is in fluid communication with a fully oil flooded head of the marine outdrive. The reservoir can be observed for an indication of oil level and oil condition. A clear plastic oil reservoir may be used to enhance visual observation.

U.S. Pat. No. 5,487,687, which issued to Idzikowski et al. on Jan. 30, 1996, discloses a midsection and cowl assembly for an outboard marine drive. The midsection housing includes an oil sump in one embodiment and further includes an exhaust passage partially encircled by cooling water and partially encircled by engine oil for muffling engine exhaust noise. The midsection housing has an oil drain arrangement providing complete and clean oil draining while the outboard drive is mounted on a boat and in the water wherein the operator can change oil without leaving the confines of the boat and entering the water.

U.S. Pat. No. 5,899,779, which issued to Hattori on May 4, 1999, describes an oil system drain for a personal watercraft. The drain arrangement is provided for a lubricating system of an engine powering a watercraft. The engine is mounted to a hull of the watercraft and includes a lubricating system having a lubricant collector positioned at a bottom of the engine and a lubricating system drain also positioned at the bottom of the engine through which lubricant may be drained from the collector.

U.S. Pat. No. 6,132,275, which issued to Tanaka et al. on Oct. 17, 2000, describes a lubricating oil managing arrangement for an outboard marine drive engine. A tubular socket member is sealingly fitted into an opening formed on one side of the crankcase of the engine at a level corresponding to a normal engine lubricating oil level and a transparent window member is sealingly fitted into an outer end of the tubular socket member. An engine cover covering the engine is provided with an opening aligned with the transparent window member so as to allow the level of lubricating oil in the crankcase to be inspected from outside the engine cover.

U.S. Pat. No. 6,575,797, which issued to Martin et al. on Jun. 10, 2003, discloses an oil drain system for an outboard motor. It provides an oil drain opening formed in a lower surface of the splash plate of the outboard motor at a location which allows oil to drain from the oil drain opening under the force of gravity in a downward direction without contacting any surfaces of the outboard motor. This allows the oil to be received by a waste oil container that is placed at any point directly below the oil drain opening, either on the ground below the gear case of the outboard motor or at any point that is vertically below the oil drain opening.

U.S. Pat. No. 6,655,341, which issued to Westerbeke on Dec. 2, 2003, describes an oil sump for vertically shafted engines. It has a housing with an upper face for sealing against a block of the engine. The sump housing defines an internal volume for containing a quantity of oil received from the engine through an oil drain opening in the upper face of the sump and defines an exhaust inlet for receiving a flow of exhaust from the engine and directing the flow of exhaust toward an exhaust outlet along an exhaust passage defined within the housing.

U.S. Pat. No. 6,755,704, which issued to Leinonen on Jun. 29, 2004, describes an oil tank drain system for a watercraft. It includes an oil reservoir coupled to a flow regulator located in the interior of the personal watercraft. The flow regulator is additionally coupled to a cover that seals an axis opening formed on the exterior of the personal watercraft by means of a tether such that when the cover is removed for an oil change the tether pulls the flow regulator to the exterior of the watercraft so that oil in the reservoir can be drained to the exterior of the watercraft.

U.S. Pat. No. 6,837,210, which issued to Tsuchiya et al. on Jan. 4, 2005, describes a lubrication unit for engines. An oil feed pump for feeding oil in an oil tank to an engine, an oil recovery pump for feeding oil in a crankcase into the oil tank, an oil drainpipe connected to the lower portion of the crankcase and extending upward, and an opening provided on top of the oil tank are provided in a lubrication system. An opening of the oil drain pipe opens at the position upward of the oil level in the crankcase at a moment when the oil in the oil tank is returned into the crankcase. A cap is provided with a dipstick. The engine can be mounted on a small planing boat with the crankshaft oriented in the fore and aft direction. The oil tank is integrally formed with the front portion of the engine so as to be elongated in the vertical direction and is formed with the opening on top.

U.S. Pat. No. 7,033,234, which issued to Arvidsson et al. on Apr. 25, 2006, describes a method of steering a boat with double outboard drives and boat having double outboard drives. The outboard drive units with underwater housings extend down from the bottom of the boat. When running at planing speed straight ahead, the underwater housings are set with "toe-in". When turning, the inner drive is set with a greater steering angle than the outer drive unit.

U.S. Pat. No. 7,118,434, which issued to Arvidsson et al. on Oct. 10, 2006, describes an outboard drive for boats. It includes an underwater housing in which two propeller shafts are mounted and are driven via a first bevel gearing enclosed in the underwater housing and a second bevel gearing enclosed in a gear housing. With the aid of a mounting element joined to the underwater housing and the gear housing, the drive unit can be mounted in an opening in the bottom of a boat hull with the underwater housing on the outside of the gear housing on the inside of the hull. The mounting element forms a housing which defines firstly an oil reservoir for the oil of the drive unit and secondly a surrounding chamber through which engine cooling water flows and which is used for cooling the oil in the reservoir.

U.S. Pat. No. 7,131,385, which issued to Ehlers et al. on Nov. 7, 2006, discloses a method for braking a vessel with two marine propulsion devices. It comprises the steps that rotate two marine propulsion devices about their respective axes in order to increase the hydrodynamic resistance of the marine propulsion devices as they move through the water with the marine vessel. This increased resistance exerts a braking thrust on the marine vessel. Various techniques and procedures can be used to determine the absolute magnitudes of the angular magnitudes by which the marine propulsion devices are rotated.

U.S. Pat. No. 7,182,657, which issued to Mansson on Feb. 27, 2007, describes a boat hull with outboard drive and outboard drive for boats. The boat hull comprises an outboard drive unit, which comprises an underwater housing mounted on the outside of the hull bottom and a gear housing mounted on the inside of the hull bottom and joined to the underwater housing. Between the underwater housing and the gear housing there is fixed a mounting plate which together with a screw-down plate with elastic ring inserts fixes the drive unit to a flange which is made on the inside of a well surrounding an opening in the hull bottom.

U.S. Pat. No. 7,186,157, which issued to Mansson et al. on Mar. 6, 2007, describes a turning propeller drive for a boat. The propeller drive includes an upper fixing plate adapted for a rotational fixed attachment to the hull bottom of the boat. A lower underwater housing is provided in which at least one propeller is mounted which underwater housing is mounted rotatably in the fixing plate about an essentially vertical axis of rotation. An exhaust duct is provided with an exhaust exit located in the underwater housing. The exhaust duct has an upper duct section which extends through the fixing plate and has an outlet opening located in proximity to an opposite inlet opening in a lower duct section which extends through the underwater housing. One of the outlet opening and inlet opening overlaps the other at least within a limited first rotational angle range for the propeller drive. A sliding seal arrangement is adapted for sealing between the upper and lower duct sections, where the sliding seal arrangement includes a sealing element accommodated in a seat around one of the outlet opening and inlet opening.

U.S. Pat. No. 7,188,581, which issued to Davis et al. on Mar. 13, 2007, discloses a marine drive with an integrated trim tab. A marine drive and a marine vessel and drive combination have a trim tab with a forward end pivotally mounted to a marine propulsion device.

U.S. Pat. No. 7,234,983, which issued to Davis on Jun. 26, 2007, discloses a protective marine vessel and drive. A marine vessel and drive combination includes port and starboard tunnels formed in a marine vessel hull raising port and starboard steerable marine propulsion devices to protective positions relative to the keel.

U.S. Pat. No. 7,267,068, which issued to Bradley et al. on Sep. 11, 2007, discloses a method for maneuvering a marine vessel in response to a manually operable control device. A marine vessel is maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

The patents described above are hereby expressly incorporated by reference in the description of the present invention.

Removing oil from an oil sump of a marine propulsion device typically uses a discharge port that is at or near the lowest portion of the oil sump. Then, with the aid of gravity, the oil can be allowed to flow out of the marine drive unit into an appropriate container to collect the used oil from the drive unit and dispose of it. This procedure becomes much more complex when the drive unit is located below the hull of a marine vessel. Certain types of marine propulsion systems incorporate rotatable drive units that extend downwardly from the hull of the marine vessel. Systems of this type are described in U.S. Pat. Nos. 7,033,234 and 7,182,657 which are described above. In addition, marine propulsion systems with drive units that extend downwardly below the hull of a marine vessel are described in U.S. Pat. Nos. 7,188,581 and 7,234,983.

It would be significantly beneficial if an efficient and effective way of removing oil from drive units in marine propulsion systems that are located below the hull of a marine vessel could be provided.

SUMMARY OF THE INVENTION

A lubrication system of a marine propulsion device made in accordance with a preferred embodiment of the present invention comprises a rotatable portion and a stationary portion. The rotatable portion extends downwardly from a hull beneath a marine vessel and is configured to support a propeller shaft for rotation about a generally horizontal propeller axis. The stationary portion of the marine propulsion device is disposed above the hull and within the bilge of the marine vessel. The stationary portion is configured to support the rotatable portion for rotation about a generally vertical steering axis. A preferred embodiment of the present invention further comprises a cavity within the rotatable portion. The cavity is configured to contain oil therein. First, second and third liquid passages are also provided in a preferred embodiment of the present invention. A first liquid passage extends from a position proximate a bottom region of the cavity to a position at a top region of the rotatable portion. The second liquid passage comprises a space between the stationary and rotatable portions of the marine propulsion device. The space of the second liquid passage is disposed below a surface of the stationary portion and above a surface of the rotatable portion. The third liquid passage is formed in the stationary portion of the marine propulsion device. The first and third liquid passages are disposed in fluid communication with the space of the second liquid passage. The present invention further comprises a discharge port connected in fluid communication with the third liquid passage. The discharge port is disposed above the hull of the marine vessel. It is configured to be connectable to a device which is configured to induce a flow of the oil from the bottom region of the cavity, through the first liquid passage, through the space of the second liquid passage, through the third liquid passage and through the discharge port. The device is configured to create a magnitude of pressure at the discharge port which is less than a magnitude of pressure at the position proximate the bottom region of the cavity.

In a preferred embodiment of the present invention, it further comprises an oil reservoir disposed within the marine vessel above the hull. The oil reservoir is connected in fluid communication with the cavity at a position above the discharge port. The first liquid passage is a tube, in a preferred embodiment of the present invention, which is disposed at least partially within the cavity. The rotatable portion of the marine propulsion device comprises a gear case and a driveshaft which is supported for rotation about a generally vertical axis of rotation. The driveshaft is disposed in torque transmitting relation with the propeller shaft. The steering axis and the axis of rotation are coaxial with each other in a preferred embodiment of the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
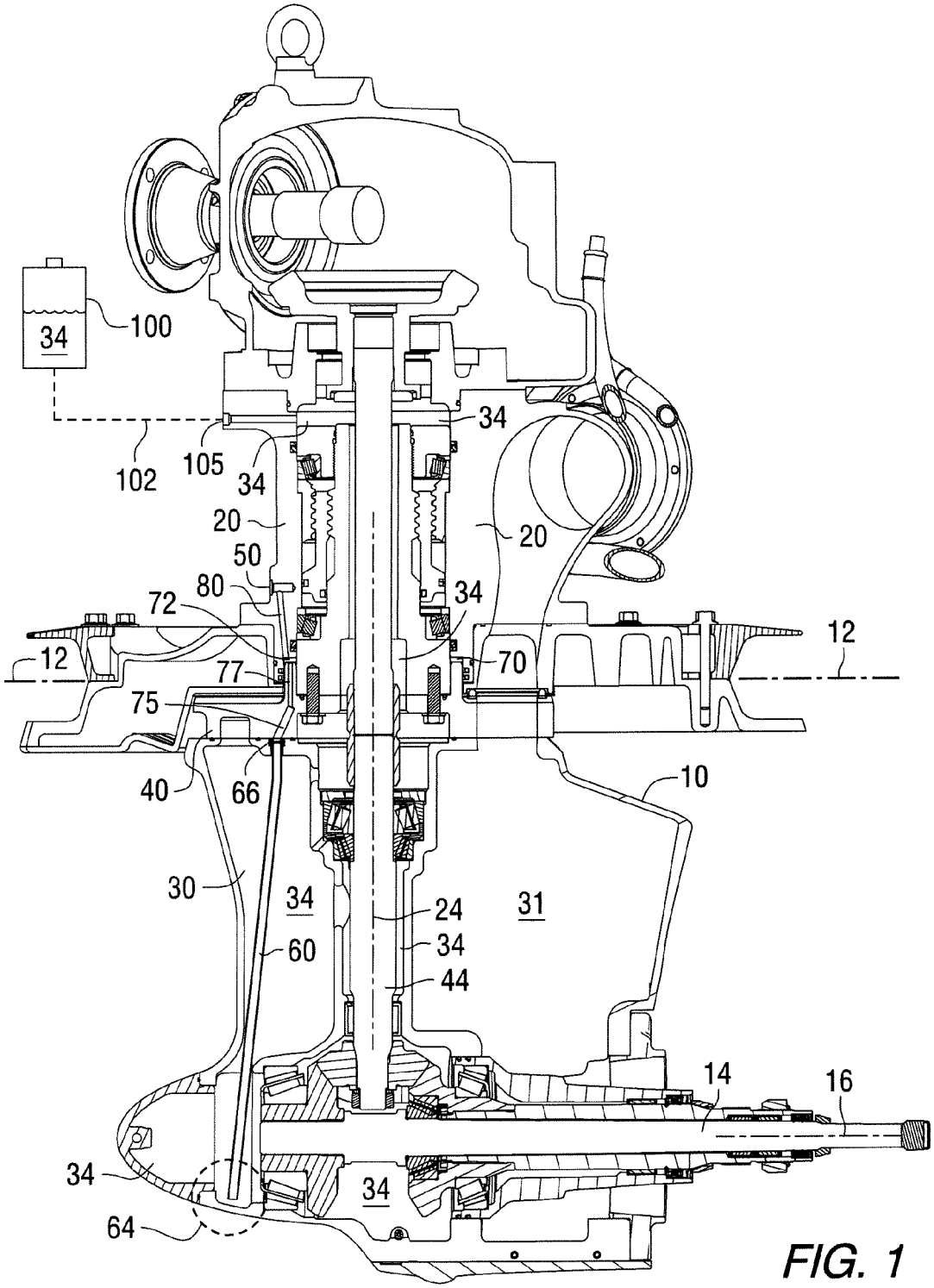
FIG. 1 is a side sectional view of a marine propulsion device incorporating the preferred embodiment of the present invention.

Throughout the description of the preferred embodiment of the present invention, like components will be identified by like reference numerals.

Figure 2:
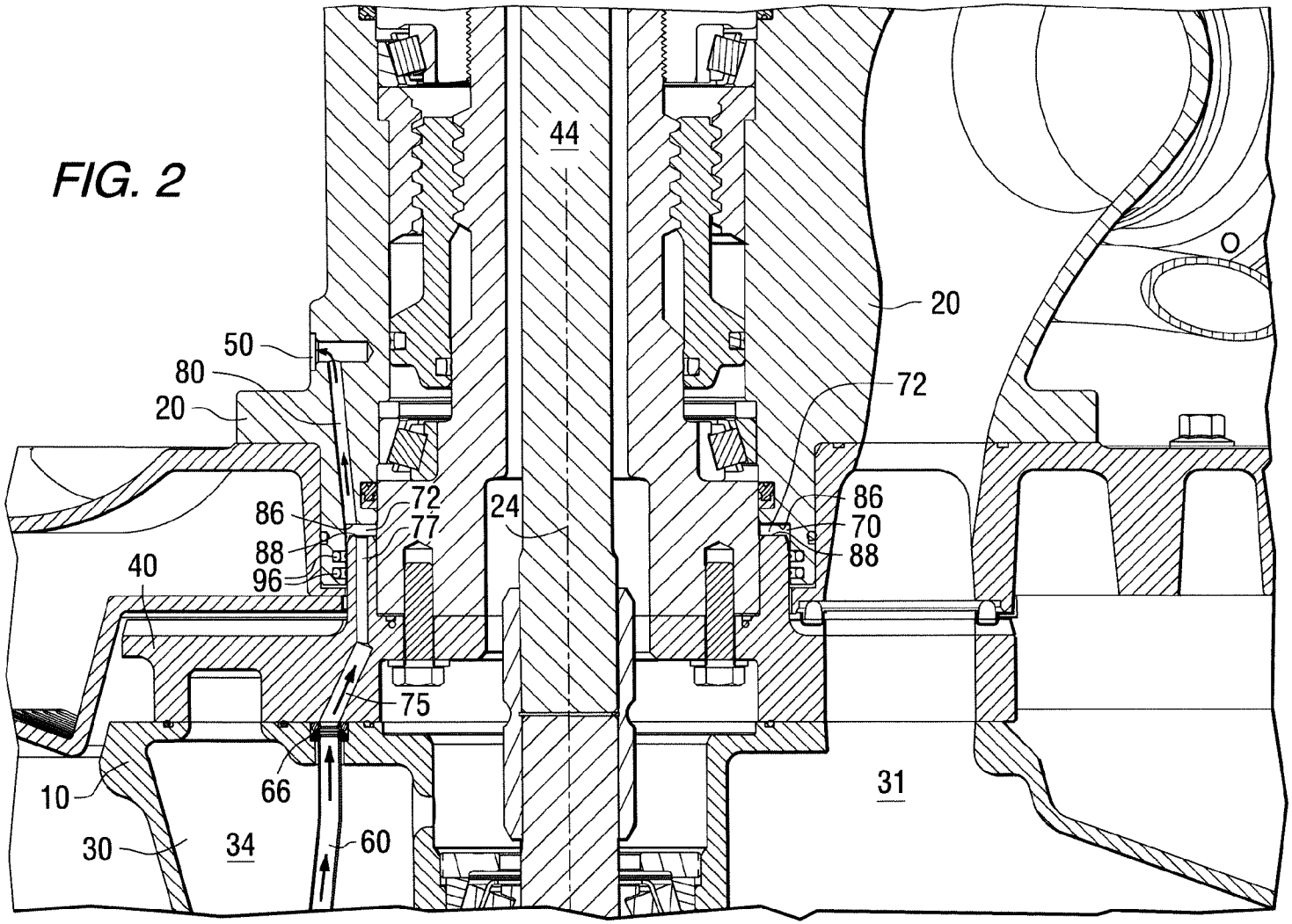
FIG. 2 is an enlarged portion of the illustration in FIG. 1.
Figure 3:
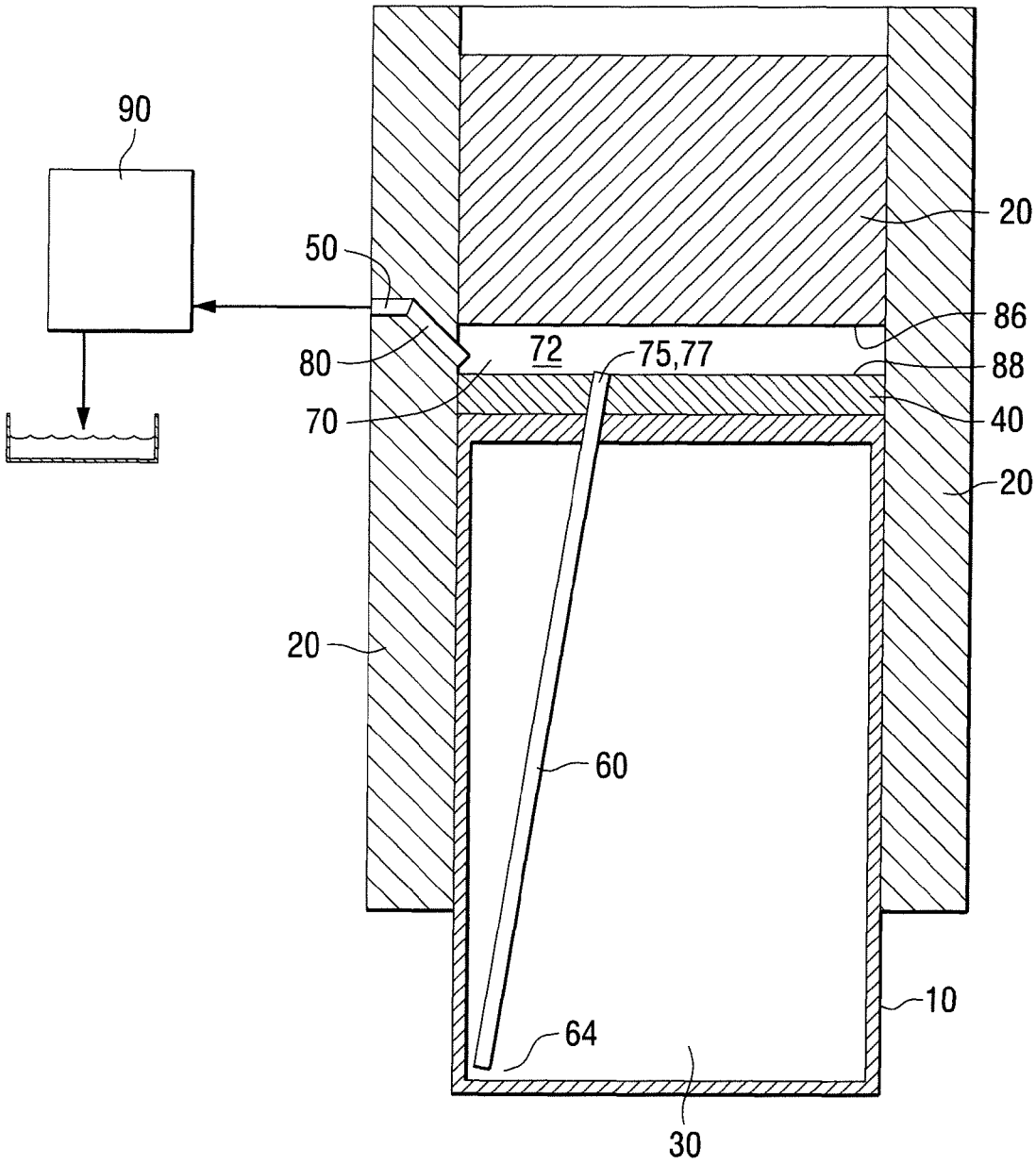
FIG. 3 is a highly simplified schematic representation showing the basic principles of the present invention.

FIG. 1 is a side section view of a marine propulsion device incorporating a preferred embodiment of the present invention. FIG. 2 is an enlarged representation of a central portion of FIG. 1, showing the first, second, and third liquid passages. FIG. 2 is intended to schematically illustrate the location and function of the space of the second liquid passage which is located between stationary and rotatable portions of the marine propulsion device. FIG. 3 is a highly simplified schematic representation showing the relative positions of various components of a marine propulsion device. The purpose of FIG. 3 is to illustrate both the problems faced when trying to drain oil from certain types of marine propulsion systems and, more specifically, to illustrate the technique implemented by the present invention to perform this function.

FIG. 1 shows a rotatable portion 10 of the marine propulsion device. It extends downwardly from a hull 12 of the marine vessel. The position of the hull (i.e. the "hull line") is represented by dashed line 12 in FIG. 1. At that position, the hull is disposed between a seal member (not shown) which is compressed by the two clamp rings shown in the Figure. The rotatable portion 10 is configured to support a propeller shaft 14 for rotation about a generally horizontal propeller axis 16. A stationary portion 20 of the marine propulsion device is disposed above the hull line 12 of the marine vessel. The stationary portion 20 is configured to support the rotatable portion 10 for rotation about a generally vertical steering axis 24. A cavity 30 within the rotatable portion 10 is configured to contain oil therein. Reference numeral 34 has been used to identify various locations in FIG. 1 where lubricating oil is contained during normal operation of the marine propulsion device.

With continued reference to FIG. 1, the embodiment shown in the illustration comprises a gear case adapter 40 which is attached to the upper surface of the rotatable portion 10. The rotatable portion 10 is alternatively referred to as a gear case because one of its primary functions is to support the gears necessary to drive the propeller shaft 14 in response to rotation of the driveshaft 44. The gear case adapter 40 rotates with the rotatable portion 10 about axis 24 which is also the steering axis of the propulsion unit. A discharge port 50 is formed in the stationary portion 20 in order to allow oil to be evacuated from the cavity 30.

A first liquid passage 60 extends from a position proximate a bottom region 64 of the cavity 30 to a position at a top region 66 of the rotatable portion 10. Reference numeral 31 designates an exhaust passageway formed in the driveshaft housing. A second liquid passage 70 comprises a space 72 between the stationary 20 and rotatable portion 10 of the marine propulsion device. A third liquid passage 80 is formed in the stationary portion 20 of the marine propulsion device. As described above, the rotatable portion 10 comprises an adapter portion 40 that is disposed below the space 72 of the second liquid passage 70. A segment, comprising conduits 75 and 77, of the first liquid passage 60 extends through the adapter portion 40.

FIG. 2 is an enlarged view of the central region of FIG. 1. It is intended to show the relationship between the space 72 of the second liquid passage 70 and the other components. The upper surface 86 of the space 72 is a surface of the stationary portion 20 while the lower surface 88 of the space 72 is an upper surface of the rotatable portion 10. More specifically, in the embodiment shown in FIGS. 1 and 2, the upper surface 88 of the rotatable portion provides the lower surface of the space 72 while the lower surface 86 of the stationary portion 20 provides the upper surface of the space 72. Within the space 72 is a quantity of lubricating oil that is in fluid communication with the lubricating oil within the cavity 30.

The space 72 of the second liquid passage 70 serves an important purpose in performing the function of the present invention. It acts as an interface between stationary and moving components and allows oil to be drawn upwardly through the other liquid passages and removed from the marine propulsion device. The third liquid passage 80 is formed in the stationary portion 20 of the marine propulsion device. It should be understood that the first liquid passage 60 and its extension portions, 75 and 77, are movable relative to the third liquid passage 80. The space 72 of the second liquid passage 70 is located between these first and third liquid passages and serves as a transition region which requires no direct physical contact between the first and third liquid passages. Instead, it provides a space 72 through which the oil can flow from the rotatable portion 10 to the stationary portion 20.

FIG. 3 is a highly schematic representation showing the functional representations of various components described above. It is very important to understand the relationships between the various stationary and movable portions in order to understand the operation of the present invention and the advantages it provides. Although the components in FIG. 3 are similar to those described above in conjunction with FIGS. 1 and 2, the simplified nature of FIG. 3 represents these components in a highly schematic manner. The rotatable portion 10 is illustrated in FIG. 3 with its cavity 30 which is configured to contain a quantity of liquid lubricating oil. The first liquid passage 60, along with its extension portions, 75 and 77, that extend through the adapter 40 is shown extending from the bottom region 64 of the cavity 30 to a position at a top region of the rotatable portion 10. It should be understood that the adapter 40 is an upper portion of the rotatable portion 10 and is rigidly attached to it. The second liquid passage 70 comprises the space 72 between the stationary 20 and rotatable 10 portions of the marine propulsion system. This space 72, which is located between opposing surfaces 86 and 88, acts as the transition between the rotatable and stationary portions of the marine propulsion device. From the space 72, the oil can continue to flow through the conduit identified by reference numeral 80, and be removed by a device 90 which is configured to induce the flow of oil from the bottom region 64 of the cavity, through the first liquid passage 60, through the space 72 of the second liquid passage 70, through the third liquid passage 80, and through the discharge port 50. The device 90 can be a relatively simple vacuum pump that reduces the pressure at the discharge port 50 to a magnitude well below the pressure at the inlet end of the first liquid passage 60. This draws the oil upwardly and out of the cavity 30.

With continued reference to FIGS. 1-3, it should be understood that the rotatable portion 10 of the marine propulsion device extends below the hull line 12 and is therefore in a difficult position to allow easy removal of lubricating oil from the sump which includes the cavity 30. Oil is normally drained from gear cases through the use of gravity to cause the oil to flow through a discharge opening at or near the very bottom of the oil sump cavity. When the oil sump is below the hull of a marine vessel, this type of oil removal would require the marine vessel being removed from the water. This is a very expensive and time consuming process. Therefore, it is significantly beneficial if the oil can be drawn out of the cavity 30 through the use of a low pressure device, such as a vacuum pump. However, this process requires the oil to pass from a cavity within a rotatable portion 10 into a stationary portion 20 and then away from the stationary portion. This process also requires that the oil be induced to flow upwardly through an opening in the hull 12. The primary difficulty in a process of this type is to provide some sort of transition through which the oil can flow between the rotatable portion 10 and the stationary portion 20. The configuration of the space 72, through the provision of a seal 96 which confines the oil within the space 72, serves this purpose. When the oil is drained from the cavity 30, it flows from the movable portion 10, through the transitional space 72 of the second liquid passage 70, and into a conduit 80 formed in the stationary portion 20. This sealed passage allows the oil to be drawn through the discharge port 50 and removed.

With continued reference to FIG. 1, it can be seen that an oil reservoir bottle 100 is provided and connected, as represented by dashed line 102, to a port 105 that is in fluid communication with the other oil containing portions of the cavity 30 and oil sump. The oil sump can be refilled by providing oil into the oil discharge port 50 until it fills reservoir 100. Similarly, during the evacuation of oil through the discharge port 50, the cap of the oil reservoir 100 is removed to allow air to flow into the cavity 30 as it is being evacuated of liquid oil.

With continued reference to FIGS. 1-3, it can be seen that the discharge port 50 is above the hull line 12 and in the bilge portion of the marine vessel. This facilitates the removal of the oil. The vacuum pump can be attached to the discharge port 50 at a position above the hull line 12 where the oil can be collected and removed.

The lubrication system of a marine propulsion device made in accordance with a preferred embodiment of the present invention comprises a rotatable portion 10 extending downwardly from a hull 12 of a marine vessel. The rotatable portion 10 is configured to support a propeller shaft 14 for rotation about a generally horizontal propeller axis 16. A stationary portion 20 of the marine propulsion device is disposed above the hull line 12 and is configured to support the rotatable portion 10 for rotation about a generally vertical steering axis 24. A cavity 30 within the rotatable portion 10 is configured to contain liquid oil therein. The gear case is a portion of the rotatable portion 10. A first liquid passage 60 extends from a position proximate a bottom region 64 of the cavity 30 to a position at a top region of the rotatable portion 10. A second liquid passage 70 comprises a space 72 between the stationary 20 and rotatable 10 portions of the marine propulsion device. The space 72 of the second liquid passage 70 is disposed below a surface 86 of the stationary portion and above a surface 88 of the rotatable portion 10. A third liquid passage 80 is formed in the stationary portion 20. The first and third liquid passages, 60 and 80, are disposed in fluid communication with the space 72 of the second liquid passage 70. A discharge port 50 is connected in fluid communication with the third liquid passage 80 and is disposed above the hull line 12 of the marine vessel. The discharge port 50 is connectable to a device 90 which is configured to induce a flow of the oil from the bottom region 64 of the cavity 30, through the first liquid passage 60, through the space 72 of the second liquid passage 70, through the third liquid passage 80, and to the discharge port 50. The device 90 is configured to create a magnitude of pressure at the discharge port 50 which is less than a magnitude of pressure at the position proximate the bottom region 64 of the cavity 30. An oil reservoir 100 is disposed within the marine vessel above the hull line 12. The oil reservoir 100 is connected in fluid communication with the cavity 30 at a position above the discharge port 50. The first liquid passage 60 is a tube in a preferred embodiment of the present invention and is disposed at least partially within the cavity 30. The rotatable portion 10 of the marine propulsion device comprises a gear case and driveshaft 44 which is supported for rotation about a generally vertical axis of rotation 24. The driveshaft 44 is disposed in torque transmitting relation with the propeller shaft 14. The steering axis and the axis of rotation are generally coaxial with each other.

Although the present invention has been described with particular specificity and illustrated to show a preferred embodiment, it should be understood that alternative embodiments are also within its scope.

I claim:

1. A lubrication system of a marine propulsion device, comprising:

a rotatable portion of said marine propulsion device extending downwardly from a hull of a marine vessel, said rotatable portion being configured to support a propeller shaft for rotation about a generally horizontal propeller axis;

a stationary portion of said marine propulsion device disposed above said hull of said marine vessel, said stationary portion being configured to support said rotatable portion for rotation about a generally vertical steering axis;

a cavity within said rotatable portion, said cavity being configured to contain oil therein;

a first liquid passage extending from a position proximate a bottom region of said cavity to a position at a top region of said rotatable portion;

a second liquid passage which comprises a space between said stationary and rotatable portions of said marine propulsion device;

a third liquid passage formed in said stationary portion of said marine propulsion device; and a discharge port connected in fluid communication with said third liquid passage.

2. The lubrication system of claim 1, wherein:

said discharge port is configured to be connectable to a device which is configured to induce a flow of said oil from said bottom region of said cavity, through said first liquid passage, through said space of said second liquid passage, through said third liquid passage, and to said discharge port.

3. The lubrication system of claim 1, wherein:

said space of said second liquid passage is disposed below a surface of said stationary portion and above a surface of said rotatable portion.

4. The lubrication system of claim 3, wherein:

said first and third liquid passages are disposed in fluid communication with said space of said second liquid passage.

5. The lubrication system of claim 1, wherein:

said first liquid passage is a tube which is disposed at least partially within said cavity.

6. The lubrication system of claim 2, wherein:

said device is configured to create a magnitude of pressure at said discharge port which is less than a magnitude of pressure at said position proximate said bottom region of said cavity.

7. The lubrication system of claim 1, wherein:

said rotatable portion of said marine propulsion device comprises a gear case and a drive shaft which is supported for rotation about a generally vertical axis of rotation, said drive shaft being disposed in torque transmitting relation with said propeller shaft.

8. The lubrication system of claim 7, wherein:

said steering axis and said axis of rotation are coaxial with each other.

9. The lubrication system of claim 1, wherein:

said rotatable portion comprises an adaptor portion disposed below said space, a segment of said first liquid passage extending through said adaptor portion.

10. The lubrication system of claim 2, further comprising:

an oil reservoir disposed within said marine vessel above said hull, said oil reservoir being connected in fluid communication with said cavity at a position above said discharge port.

11. The lubrication system of claim 2, wherein:

said discharge port is disposed above said hull of said marine vessel.

12. A lubrication system of a marine propulsion device, comprising:

a rotatable portion of said marine propulsion device extending downwardly from a hull of a marine vessel, said rotatable portion being configured to support a propeller shaft for rotation about a generally horizontal propeller axis;

a stationary portion of said marine propulsion device disposed above said hull of said marine vessel, said stationary portion being disposed at least partially within a bilge of said marine vessel and configured to support said rotatable portion for rotation about a steering axis;

a cavity within said rotatable portion, said cavity being configured to contain oil therein;

a first liquid passage extending from a position proximate a bottom region of said cavity to a position at a top region of said rotatable portion;

a second liquid passage which comprises a space between said stationary and rotatable portions of said marine propulsion device, said space of said second liquid passage being disposed below a surface of said stationary portion and above a surface of said rotatable portion;

a third liquid passage formed in said stationary portion of said marine propulsion device; and a discharge port connected in fluid communication with said third liquid passage, said discharge port being disposed above said hull of said marine vessel.

13. The lubrication system of claim 12, wherein:

said first and third liquid passages are disposed in fluid communication with said space of said second liquid passage.

14. The lubrication system of claim 12, wherein:

said first liquid passage is a tube which is disposed at least partially within said cavity.

15. The lubrication system of claim 12, wherein:

said discharge port is configured to be connectable to a device which is configured to induce a flow of said oil from said bottom region of said cavity, through said first liquid passage, through said space of said second liquid passage, through said third liquid passage, and to said discharge port.

16. The lubrication system of claim 15, wherein:

said device is configured to create a magnitude of pressure at said discharge port which is less than a magnitude of pressure at said position proximate said bottom region of said cavity.

17. The lubrication system of claim 12, wherein:

said rotatable portion of said marine propulsion device comprises a gear case and a drive shaft which is supported for rotation about a generally vertical axis of rotation, said drive shaft being disposed in torque transmitting relation with said propeller shaft, said steering axis and said axis of rotation being coaxial with each other, said rotatable portion comprising an adaptor portion disposed below said space, a segment of said first liquid passage extending through said adaptor portion.

18. The lubrication system of claim 12, further comprising:

to an oil reservoir disposed within said marine vessel above said hull, said oil reservoir being connected in fluid communication with said cavity at a position above said discharge port.

19. A lubrication system of a marine propulsion device, comprising:

a rotatable portion of said marine propulsion device extending downwardly from a hull of a marine vessel, said rotatable portion being configured to support a propeller shaft for rotation about a generally horizontal propeller axis;

a stationary portion of said marine propulsion device disposed above said hull of said marine vessel, said stationary portion being configured to support said rotatable portion for rotation about a generally vertical steering axis;

a cavity within said rotatable portion, said cavity being configured to contain oil therein;

a first liquid passage extending from a position proximate a bottom region of said cavity to a position at a top region of said rotatable portion;

a second liquid passage which comprises a space between said stationary and rotatable portions of said marine propulsion device, said space of said second liquid passage is disposed below a surface of said stationary portion and above a surface of said rotatable portion;

a third liquid passage formed in said stationary portion of said marine propulsion device, said first and third liquid passages being disposed in fluid communication with said space of said second liquid passage; and a discharge port connected in fluid communication with said third liquid passage, said discharge port being disposed above said hull of said marine vessel, said discharge port being configured to be connectable to a device which is configured to induce a flow of said oil from said bottom region of said cavity, through said first liquid passage, through said space of said second liquid passage, through said third liquid passage, and to said discharge port, said device being configured to create a magnitude of pressure at said discharge port which is less than a magnitude of pressure at said position proximate said bottom region of said cavity.

20. The lubrication system of claim 19, further comprising:

an oil reservoir disposed within said marine vessel above said hull, said oil reservoir being connected in fluid communication with said cavity at a position above said discharge port, said first liquid passage being a tube which is disposed at least partially within said cavity, said rotatable portion of said marine propulsion device comprising a gear case and a drive shaft which is supported for rotation about a generally vertical axis of rotation, said drive shaft being disposed in torque transmitting relation with said propeller shaft, said steering axis and said axis of rotation being coaxial with each other.

* * * * *